US005176125A

United States Patent [19]

Jang

[11] Patent Number: 5,176,125

[45] Date of Patent: Jan. 5, 1993

[54] ASSEMBLY MEANS OF HOUSING BODY OF SMOKE EXHAUSTER

[76] Inventor: Sun-Sing Jang, 650, Yuan-Huan E. Rd., Fong-Yuan, Taichung Hsien, Taiwan

[21] Appl. No.: 818,200

[22] Filed: Jan. 8, 1992

[51] Int. Cl.[5] ..... F24C 15/20

[52] U.S. Cl. ..... 126/299 D; 285/424

[58] Field of Search ..... 403/335, 336, 383; 285/424; 126/299 R, 299 D

[56] References Cited

U.S. PATENT DOCUMENTS

| | | | |
|---|---|---|---|
| 1,791,255 | 2/1931 | Wagner | 285/424 |
| 1,992,312 | 2/1935 | Kuehh | 285/424 |
| 2,703,110 | 3/1955 | Curtis | 285/424 |

*Primary Examiner*—Carroll B. Dority
*Attorney, Agent, or Firm*—Browdy and Neimark

[57] ABSTRACT

A smoke exhauster including a top plate, a right plate and a left plate. Both left and right edges of the top plate are bent downwardly and then inwardly for 180 degrees so as to form basic strip portions containing a receiving space. The top edges of left and right plates are provided with a lower horizontal plate extending inwardly and horizontally therefrom. Each of lower horizontal plates comprises a curved portion extending upwardly from the outer edge thereof. The upper edge of the curved portion extends outwardly and horizontally to form an upper horizontal plate. The top, left, and right plates are united to form a housing body in such manners that upper horizontal plates of left and right plates are inserted into the receiving spaces of top plate and a molding tool is used to pack the upper and the lower horizontal plates and the basic strip portions. The housing body so made is devoid of sharp edges so as to prevent the user from being injured.

1 Claim, 3 Drawing Sheets

ASSEMBLY MEANS OF HOUSING BODY OF SMOKE EXHAUSTER

BACKGROUND OF THE INVENTION

The present invention relates to a kitchen smoke exhauster for exhausting heat, smoke and fumes, and more particularly to the housing body of a smoke exhauster.

As shown in FIGS. 1-3, the housing body 10 of a smoke exhauster of the prior art comprises top plate 11, left plate 12, right plate 13, and rear plate 14. Both left and right plates 12 and 13 are respectively provided with the projected strips 121 and 131 disposed on the rims thereof. In the process of combining various plates to form a housing body 10, both left and right plates 12 and 13 are united with the top plate 11 by fitting the projected strips 121 and 131 over the left and the right edges of the top plate 11. The top plate 11, the left plate 12, and the right plate 13 of the housing body 10 are further fastened securely by means of spot welding.

The housing body 10 of the prior art smoke exhauster described above is defective in design in that the projected strips 121 and 131 fitting over the edges of top plate 11 have sharp edges, which often become potential safety hazards, especially to a person who is doing the cleaning and the washing of the housing body 10. The projected strips 121 and 131 of the left plate 12 and the right plate 13 are often left plate 12 and the right plate 13 are often left with sharp edges in view of the fact that left and right plates 12 and 13 are made of thin plates of stainless steel by means of punching and pressing. The addition, there are many visible marks of the weld points 122 and 132 left on the housing body 10 by spot welding, as shown in FIG. 2. Such weld points 122 and 132 seriously undermine the aesthetic effect of the housing body 10.

SUMMARY OF THE INVENTION

The main object of the present invention is to provide a smoke exhauster with a housing body devoid of sharp edges capable of inflicting an injury to a user or a worker.

Another object of the present invention is to provide a smoke exhauster with a housing body destitute of weld points so as to enhance the aesthetic effect of the smoke exhauster.

The above and other objects, features and advantages of the present invention will be fully understood from the following description considered in connection with the accompanying drawings which illustrate the best mode for practicing the present invention.

DETAILED DESCRIPTION OF THE PREFERRED EMBODIMENTS

Figure 1:
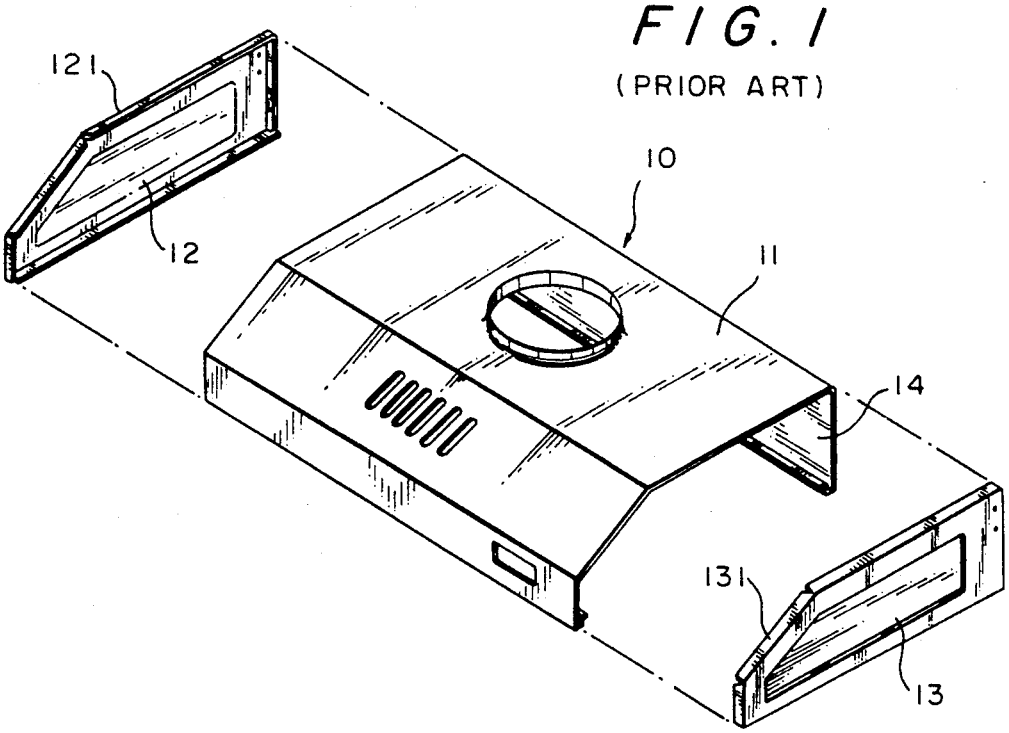
FIG. 1 (PRIOR ART)
FIG. 1 is a schematic view of the structure of housing body of the prior art smoke exhauster.
Figure 2:
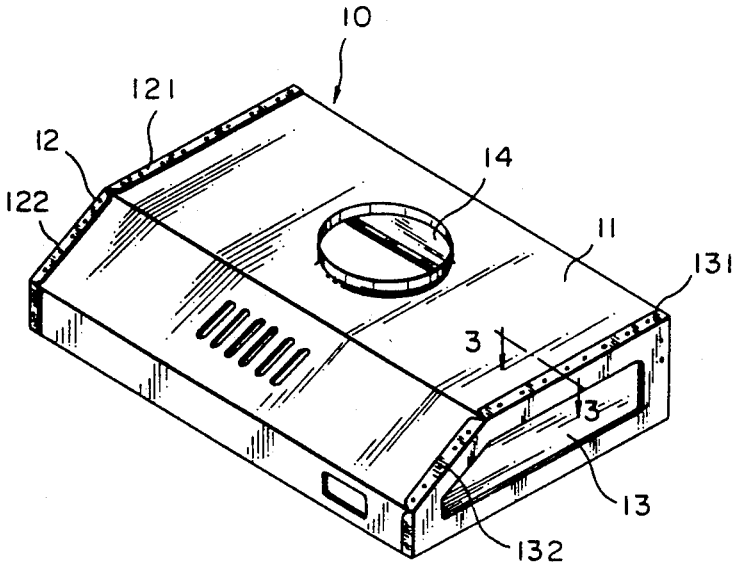
FIG. 2 (PRIOR ART)
FIG. 2 is a perspective assembly view showing a smoke exhauster in FIG. 1.
Figure 3:
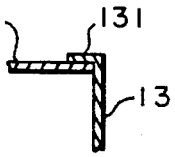
FIG. 3 (PRIOR ART)
FIG. 3 is an enlarged sectional view taken along line 3—3 in FIG. 2.
Figure 4:
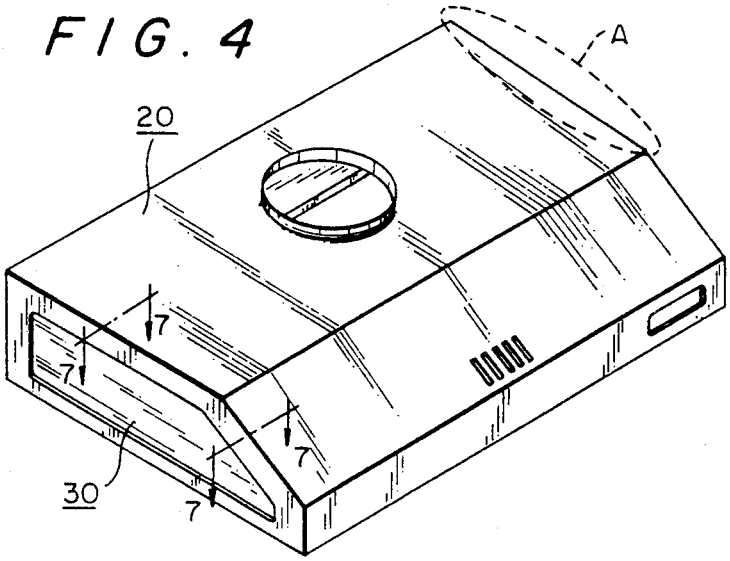
FIG. 4 is an external perspective view showing a housing body of a smoke exhauster according to the present invention.

Referring to FIGS. 4-8, the top plate 20 of the housing embodied in the first preferred embodiment of the present invention is shown comprising a basic strip portion 21 formed by the left and the right sides of top plate 20 bending downwardly and then inwardly for 180 degrees so as to form a receiving space 23. The outer edge of basic strip portion 21 bends downwardly and outwardly for 180 degrees to form a short strip portion 22. A lower horizontal plate 31 is constructed by the top edges of left plate 30 and right plate 40. The outer edge of lower horizontla plate 31 extends upwardly to form a curved portion 32, which in turn extends horizontally and outwardly to form an upper horizontal plate 33.

Figure 6:
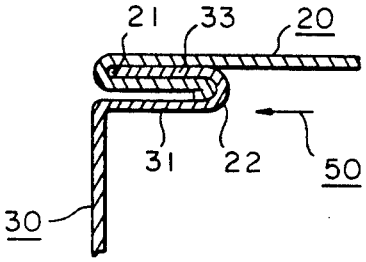
FIG. 6 is a schematic view showing the combination of structures as shown in FIG. 5.
Figure 7:
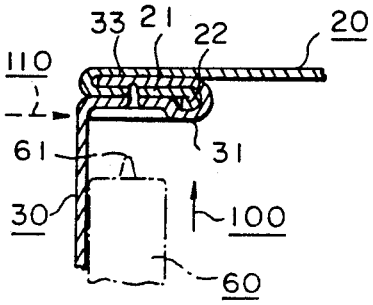
FIG. 7 is a sectional view taken along line 7—7 in FIG. 4.

In the process of combining the structures described above, the upper horizontal plate 33 of left plate 30 is fitted into the receiving space 23 of top plate 20 in a direction indicated by an arrow 50 as shown in FIG. 6. Thereafter, the lower horizontal plate 31 of left plate 30 and the basic strip portion 21 of top plate 20 are packed in a direction indicated by an arrow 100 by means of a rectangular molding tool 60 so that a slight depression is formed respectively on the lower horizontal plate 31 and the basic strip portion 21. In addition, the molding tool 60 is provided on the top end thereof with a plurality of spikes 61 spaced at a predetermined interval, as shown in FIG. 7. As a result, the spike 61 punches through the lower horizontal plate 31 and the basic strip portion 21, along with the upper horizontal plate 33 which is punched for an appropriate depth. Therefore, the depressed portion of lower horizontal plate 31 is embraced by the basic strip portion 21 whose depressed portion is in turn contained in the upper horizontal plate 33. The top plate 20 and the left plate 30 are held together in such a unique manner as described above that they are not vulnerable to falling apart at the time when an external force, which is indicated by a dotted arrow 110 as shown in FIG. 7, exerts upon top plate 20 and left plate 30 during the assembly or the transportation of the housing of cooker hood embodied in the present invention.

Figure 8:
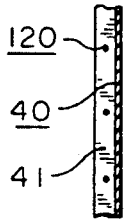
FIG. 8 is a bottom view of the A portion as shown in FIG. 4.
Figure 5:
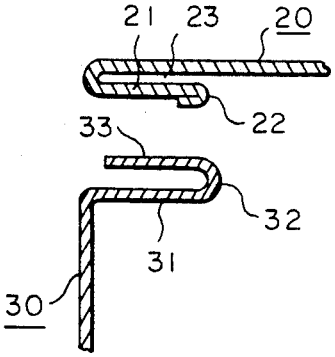
FIG. 5 is a schematic view showing features of separated structures of the first preferred embodiment of the present invention.

Now referring to FIG. 8, the basic strip portion 41 of right plate 40 is shown comprising punch holes 120 formed by means of a spike 61.

Figure 9:
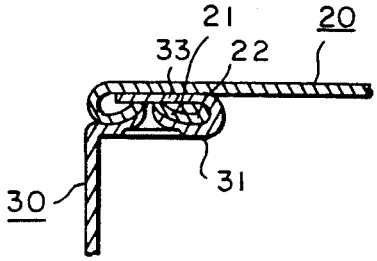
FIG. 9 is a schematic view of structural features of the second preferred embodiment according to the present invention.

As shown in FIG. 9, a second preferred embodiment of the present invention differs from the first preferred embodiment of the present invention in that the short strip portion 22 of top plate 20 is formed by the outer edge of basic strip portion 21, which bends upwardly and then outwardly.

Figure 10:
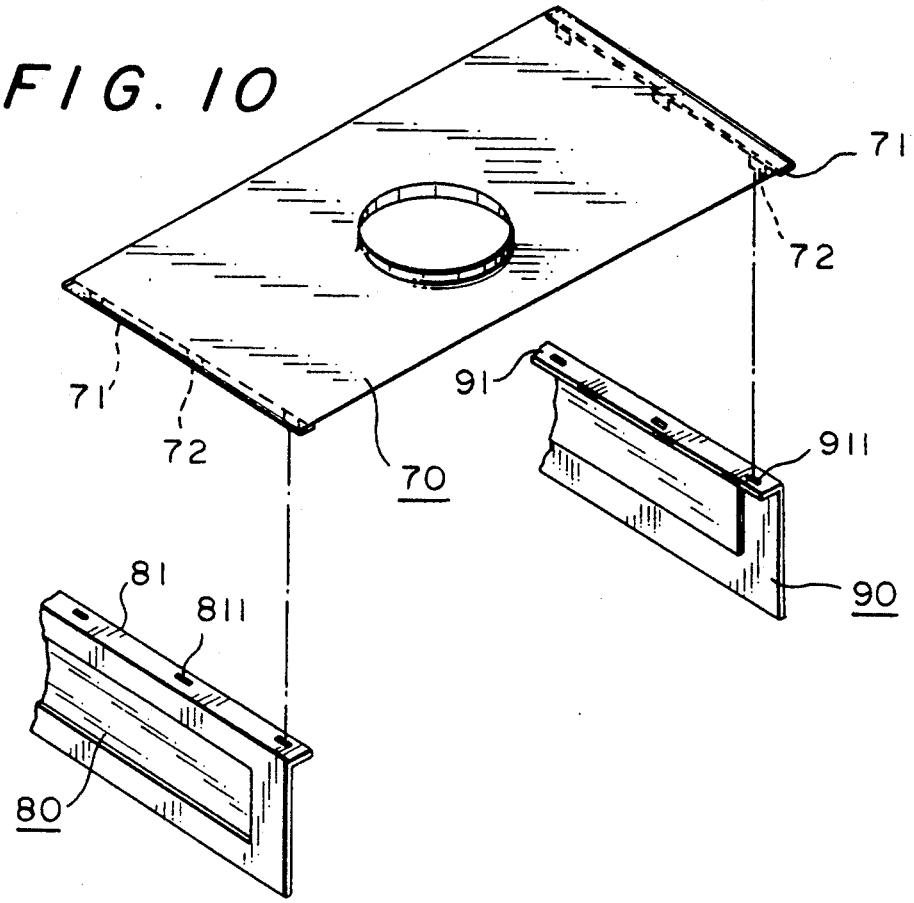
FIG. 10 is a schematic view of structural features of the third preferred embodiment according to the present invention.
Figure 11A:
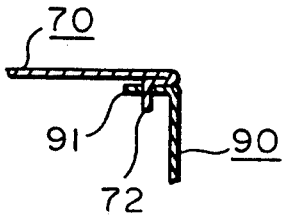
FIGS. 11A and 11B are schematic views of combination of structures of the third preferred embodiment according to the present invention.
Figure 11B:
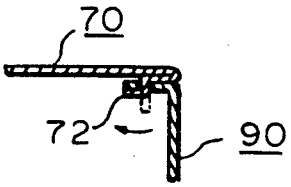

A third preferred embodiment of the present invention is shown and illustrated in FIGS. 10 and 11, in which the edges of both left right sides of top plate 70 are bent downwardly and then inwardly for 180 degrees so as to form a basic strip portion 71 comprising at the outer edge thereof a plurality of lugs 72 extending downwardly. The top edges of left and right plates 80 and 90 comprise at their respective top edges the bent strip portions 81 and 91 facing inwardly and having a plurality of perforations 811 and 911 corresponding to lugs 72 in number and position.

In the process of assembling the housing body of the third preferred embodiment, lugs 72 of the top plate 70 are inserted respectively into the corresponding perforations 811 and 911, as shown in FIG. 11 (A). Thereafter, the lower segment of each lug 72 is bent so as to ensure that each lug 72 is secured in place, as shown in FIG. 11 (B).

The housing body of smoke exhauster as embodied in the present invention have the following advantages over the prior art:

(a) The edges of top plate, left plate, and right plate are united in such a manner that they are devoid of any exposed sharp edges so as to prevent the assembly worker or the user of hood from being injured accidentally by such sharp edges.

(b) The housing body of smoke exhauster of the present invention is completely devoid of weld points so that its aesthetic effect is greatly enhanced.

Although certain preferred embodiments have been shown and described, it should be understood that many changes and modifications may be made therein without departing from the scope of the appended claims.

What is claimed is:

1. A smoke exhauster comprising a top plate and a left plate, a right plate, said top plate having left and right edges bending downwardly and inwardly for 180 degrees to form basic strip portions provided therein with a receiving space, the outer edge of said basic strip portion bends downwardly and outwardly for 180 degrees to form a short strip portion, said left plate and said right plate having respectively a top edge comprising a lower horizontal plate extending inwardly and horizontally therefrom and having an outer edge extending upwardly to form a curved portion provided with an upper horizontal plate extending outwardly and horizontally from the upper edge thereof; said top, left, and right plates making up of said housing body in such manners that said upper horizontal plates of said left and right plates are inserted into said receiving spaces of said top plates said, lower horizontal plate of said right and left plates extending inwardly and including spots deformed inwardly toward said inwardly extending portion of said top plate to lock the left and right plates with the top plate.

* * * * *